US008726422B1

(12) United States Patent
Pirela et al.

(10) Patent No.: US 8,726,422 B1
(45) Date of Patent: May 20, 2014

(54) LEGGING WHICH ENHANCES THE APPEARANCE OF A USER'S LEG

(71) Applicants: Janet Pirela, El Paso, TX (US); Miguel Angel Pirela-Cruz, El Paso, TX (US)

(72) Inventors: Janet Pirela, El Paso, TX (US); Miguel Angel Pirela-Cruz, El Paso, TX (US)

( * ) Notice: Subject to any disclaimer, the term of this patent is extended or adjusted under 35 U.S.C. 154(b) by 0 days.

(21) Appl. No.: 13/676,491

(22) Filed: Nov. 14, 2012

Related U.S. Application Data

(60) Provisional application No. 61/559,624, filed on Nov. 14, 2011.

(51) Int. Cl.
*A41B 11/00* (2006.01)

(52) U.S. Cl.
USPC ..... 2/242

(58) Field of Classification Search
USPC ..... 2/242, 22, 23, 24, 79, 227, 268, 455, 2/241, 456, 911; 128/882; 602/23, 25, 602/62; 623/27, 32, 36
See application file for complete search history.

(56) References Cited

U.S. PATENT DOCUMENTS

| | | | | | |
|---|---|---|---|---|---|
| 5,652,957 | A * | 8/1997 | Williford et al. | ..... | 2/22 |
| 5,732,713 | A * | 3/1998 | Duback et al. | ..... | 128/846 |
| 5,880,964 | A * | 3/1999 | Schall et al. | ..... | 700/159 |
| 6,065,152 | A * | 5/2000 | Parker | ..... | 2/22 |
| 6,131,206 | A * | 10/2000 | Vayda | ..... | 2/315 |
| 7,003,803 | B1 * | 2/2006 | Lyden | ..... | 2/22 |
| 7,096,507 | B1 * | 8/2006 | Bolden | ..... | 2/22 |
| 7,797,072 | B2 * | 9/2010 | Summit | ..... | 700/119 |
| 7,799,090 | B2 * | 9/2010 | Takami et al. | ..... | 623/27 |

* cited by examiner

*Primary Examiner* — Tejash Patel
(74) *Attorney, Agent, or Firm* — Plager Schack, LLP

(57) ABSTRACT

A leg covering enhances aesthetic appearance of disproportionate musculature, provides a natural look for medical prosthetics, and insulates body heat. The leg covering comprises a padding fixed to the leg covering, where the padding further comprises a contoured shape, such that the padding can be affixed on a centroid of a user's leg. The padding further comprises three layers and a contoured shape in order to model curvature of a natural calf muscle and to provide the lifelike and appealing appearance.

7 Claims, 3 Drawing Sheets

LEGGING WHICH ENHANCES THE APPEARANCE OF A USER'S LEG

CROSS REFERENCE TO RELATED APPLICATIONS

This application claims priority to U.S. Provisional Patent Application 61/559,624 filed on Nov. 14, 2011.

FIELD OF THE INVENTION

This invention relates to garments of the stocking type without foot portions worn inside the shoe.

BACKGROUND OF THE INVENTION

Prior to the disclosed invention there was no product that enhanced the appearance of underdeveloped calf muscle, which gave legs a more proportionate and improved appearance. The present invention solves this problem.

As used in this application, a calf muscle refers to gastrocnemius muscle. As is well known, the gastrocnemius is located with the soleus in the posterior (back) compartment of the leg. The lateral head originates from the lateral condyle of the femur, while the medial head originates from the medial condyle of the femur. Its other end forms a common tendon with the soleus muscle; this tendon is known as the calcaneal tendon or Achilles Tendon and inserts onto the posterior surface of the calcaneus, or heel bone.

Deep to the gastrocnemius (farther from the skin) is the soleus muscle. Some anatomists consider both to be a single muscle, the triceps surae or "calf muscle", since they share a common insertion via the Achilles tendon. The plantaris muscle and a portion of its tendon run between the two muscles, which is involved in "locking" the knee from the standing position. Since the anterior compartment of the leg is lateral to the tibia, the bulge of muscle medial to the tibia on the anterior side is actually the posterior compartment. The soleus is superficial to the mid-shaft of the tibia. Frequently there is a sesamoid bone called the "fabella" in the lateral head of gastrocnemius muscle.

BRIEF SUMMARY OF THE INVENTION

A leg covering enhances aesthetic appearance of disproportionate musculature, provides a natural look for medical prosthetics, and insulates body heat. The leg covering comprises a padding fixed to the leg covering, where the padding further comprises a contoured shape, such that the padding can be affixed on a centroid of a user's leg. The padding further comprises a proximal layer, a central myocyte layer and a distal layer. The proximal layer provides comfort to a user, the central myocyte layer provides rigidity required to both plump the padding and retain its position, and the distal layer provides natural aesthetics to look lifelike and appealing. The contoured shape further comprises a proximal contour, a medial contour, a lateral contour and a distal contour. The proximal contour is concave to comfortably fit existing calf contours of the user's leg. The medial contour is convex extending to an inner calf. The lateral contour is convex and has a flatter curvature than the medial contour. The lateral contour has a greater height than the medial contour. A bottom perimeter of the medial contour and the lateral contour are concave up such that bottom of the padding is droplet-shaped and models curvature of a natural calf muscle, the distal contour should be convex to provide the lifelike and appealing appearance.

The padding further comprises a soft foam layer selected from a group consisting of polyurethane, silicone, and other soft elastic materials. The padding further comprises a pad cover made out of a stretch fabric material, the pad cover encapsulates the padding, supports weight of the padding, and provides a uniform look to the padding; in this manner, aesthetic appearance of the padded leg covering is maintained In some embodiments, the leg covering is made from a non-slip grip fabric, the non-slip grip fabric is sewn into a top interior of the leg covering in an inner hem, and can cling to the user's leg via friction, this allows the user to place the leg covering at a fixed height; this enables the user with a prosthetic limb to have more security that the padded leg covering will remain in a fixed position.

BRIEF DESCRIPTION OF THE SEVERAL VIEWS OF THE DRAWINGS

Figure 1:
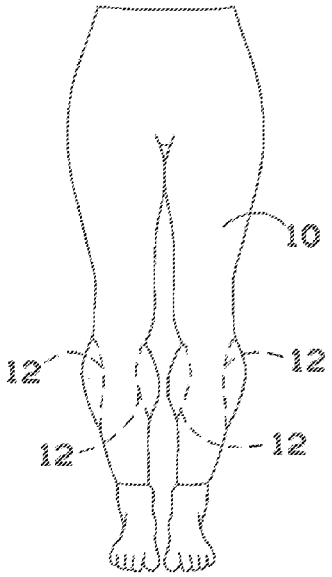

Having thus described the invention in general terms, reference will now be made to the accompanying drawings, which are not necessarily drawn to scale, and wherein:

FIG. 1 is a front view of the invention in use.

Figure 2:
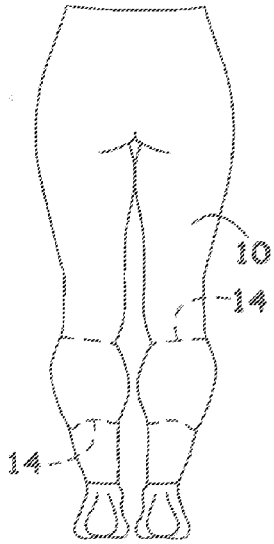

FIG. 2 is a rear view of the invention in use.

Figure 3:
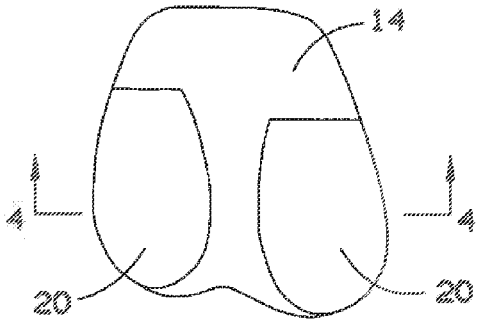

FIG. 3 is a front view of the invention in an unfolded condition.

Figure 4:
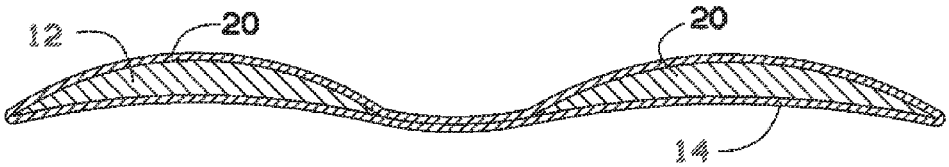

FIG. 4 is a section view of the invention taken about line 4-4 in FIG. 3.

Figure 5:
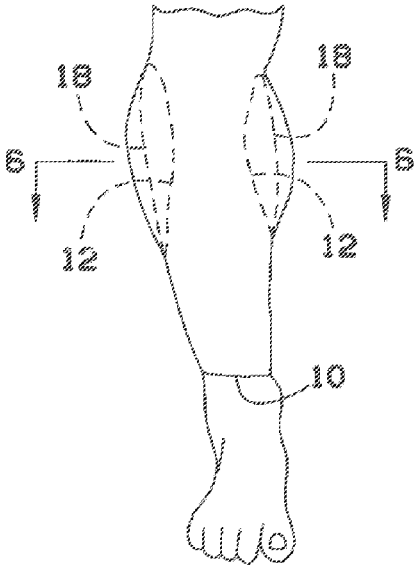

FIG. 5 is a detailed front view of the invention in use.

Figure 6:
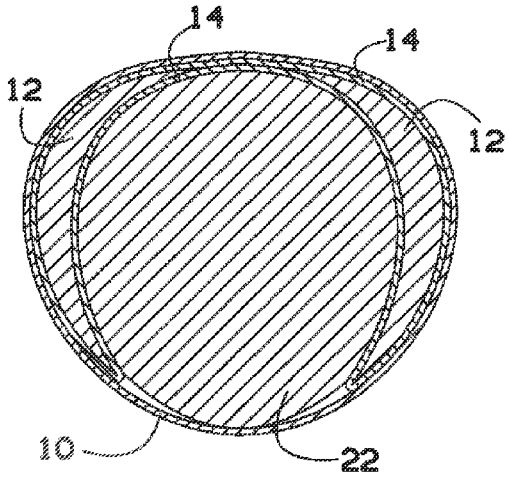

FIG. 6 is a section view of the invention taken about line 6-6 in FIG. 5.

Figure 7:
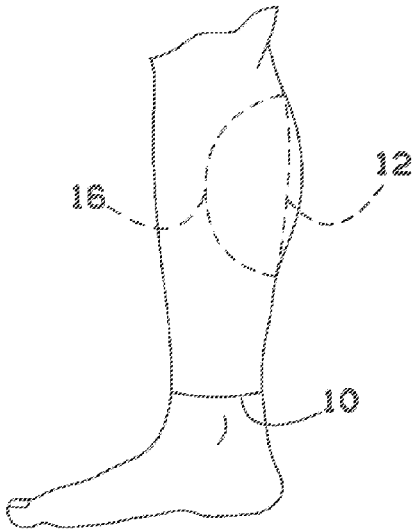

FIG. 7 is a detailed medial view of the invention in use.

Figure 8:
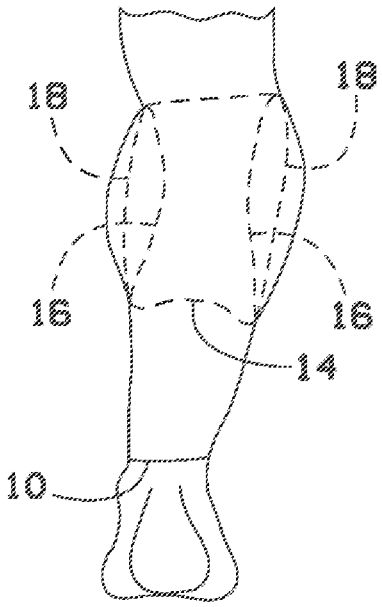

FIG. 8 is a detailed rear view of the invention in use.

Figure 9:
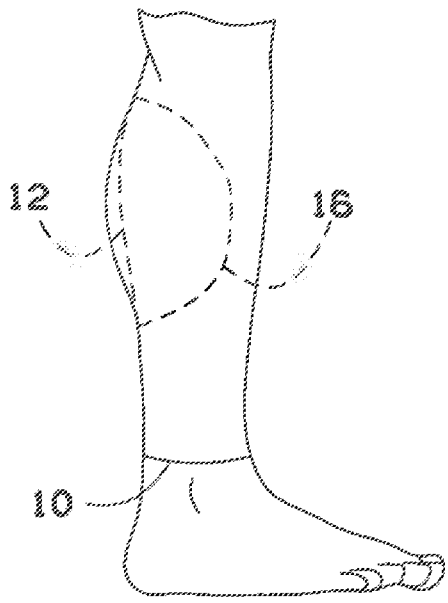

FIG. 9 is a detailed lateral view of the invention in use.

DETAILED DESCRIPTION OF THE INVENTION

Embodiments of the present invention overcome many of the obstacles associated with improving the appearance of the calf muscle, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 and FIG. 2 show the invention in use. A user has calves 22, which have an irregularly shaped musculature or the user is wearing a prosthetic leg when the user decided to improve the appearance of calf 22. The user can resolve this problem with leg coverings 10. Leg coverings 10 are mechanically coupled to padding 12, which is further covered by pad cover 14. Leg coverings 10 can utilize padding 12 and pad cover 14 to give the user the appearance of a well-formed calf 22. FIG. 3 and FIG. 4 show how this can be customized with pad pockets 20.

In some embodiments, padding 12 further comprises a soft foam layer selected from the group consisting of polyurethane, silicone, and other soft elastic materials. Pad cover 14 can be made out of a stretch fabric material, the pad cover encapsulates padding 12, supports the weight of padding 12, and provides a uniform look to padding 12. In this manner, aesthetic appearance of the padded leg covering is maintained.

FIG. 3 and FIG. 4 show the use of pad pockets 20. The present invention teaches that every calf is different, and while padding 12 can provide adequate calf shaping to many calf formations, in some instances more customized padding is required. FIG. 3 shows that pad pocket 20 can be mechanically coupled to cover 14 to allow a user to increase or decrease padding as needed to provide a well-formed calf 22. To make pad pocket 20 a user sews pad cover 14 in a manner to leave space through which padding 12 can be inserted.

In some embodiments, leg covering 10 is made from a non-slip grip fabric. The non-slip grip fabric is sewn into a top interior of the legging in an inner hem, and can cling to the user's leg via friction. This allows the user to place the legging at a fixed height. This enables a user with a prosthetic limb to have more security that the padded leg covering will remain in a fixed position with a natural look.

FIG. 5, FIG. 6, FIG. 7, FIG. 8 and FIG. 9 show how to customize padding 12 for calf 22. A user has calf 22, which has calf contour lines 18. The user desires to change the profile shape of calf contour lines 18 with padding 12. Leg covering 10 has a contoured shape such that padding 12 can be affixed to a centroid of a user's leg.

In order to ensure the contoured shape has a lifelike appearance, the following instructions may be useful. Padding 12 further comprises a contoured shape, such that padding 12 can be affixed on a centroid of a user's calf 22. Padding 12 can be made in many manners, but one embodiment further comprises a proximal layer, a central myocyte layer and a distal layer. The proximal layer provides comfort to the user. The central myocyte layer provides the rigidity required to both plump padding 12 and to ensure padding 12 can be affixed to the centroid of the user's calf 22. The distal layer provides the natural aesthetics to look lifelike and appealing.

The contoured shape further comprises a proximal contour, a medial contour, a lateral contour and a distal contour. As is well known in the art, medial describes a structure toward the midline of calf 22. Lateral refers to the contour away from the medial contour. Proximal refers to the contour of padding 12 closer to the torso, that is toward the top while the distal contour is away from the torso, that is toward the bottom.

In the preferred embodiment, the proximal contour is concave to comfortably fit the existing calf contours of a user's leg; the medial contour is convex extending to an inner calf. The lateral contour is convex and has a flatter curvature than the medial contour. The lateral contour has a greater height than the medial contour providing the padding with a natural curvature. A bottom perimeter of the medial and lateral contours are concave up such that bottom of padding 12 is droplet-shaped and models the curvature of a natural calf muscle. The distal contour should be convex to provide a lifelike and appealing appearance.

In some embodiments, leg covering 10 is a legging. In order to make the leg look appealing, the legging comprises a stretch fabric material. This provides flexibility to expand as the user sheaths their legs with the legging and contracts sufficiently on removal to be put away in an organized drawer.

In some embodiments, leg covering 10 is a pantyhose in order to enhance thermal insulation. The pantyhose comprises a non-detachable stretch fabric material to cover the hip region, which is affixed to the leg covering via sewing or manufactured as one piece. In this manner, the user may use the pantyhose to support sanitary products, and enhance thermal insulation of the user's natural body heat.

In some embodiments, leg covering 10 is further mechanically coupled to straps in order to attach a garter belt, the legging with straps comprises a detachable fabric strap, the strap should be detachably affixed to the top of the legging; this allows the user to attach the leg covering to a garter belt via the strap which holds up the leg covering and maintains the positioning of the padding for a natural and fixed appearance.

In some embodiments, leg covering 10 is further mechanically coupled to stirrups in order to increase durability while dancing. The legging with stirrups comprises a non-detachable stretch fabric material that partially covers the foot region in the shape of a stirrup, which is affixed via sewing or manufactured as one piece. The stirrup-shaped partial foot covering allows the user to use the leg covering with stirrups for ballet or dance applications which prevents the heel and toe wear and tear that is common to pirouette turns.

That which is claimed:

1. A leg covering enhances aesthetic appearance of disproportionate musculature, provides a natural look for medical prosthetics, and insulates body heat, the leg covering comprising, a padding fixed to the leg covering, where the padding further comprises a contoured shape, such that the padding can be affixed on a centroid of a user's leg; the padding further comprises a proximal layer, a central myocyte layer and a distal layer such that the proximal layer provides comfort to a user, the central myocyte layer provides rigidity required to both plump the padding and retain its position, and the distal layer provides natural aesthetics to look lifelike and appealing;

the contoured shape further comprises a proximal contour, a medial contour, a lateral contour and a distal contour; the proximal contour is concave to comfortably fit existing calf contours of the user's leg; the medial contour is convex extending to an inner calf; the lateral contour is convex and has a flatter curvature than the medial contour; a bottom perimeter of the medial contour and the lateral contour are concave up such that bottom of the padding is droplet-shaped and models curvature of a natural calf muscle, the distal contour should be convex to provide the lifelike and appealing appearance.

2. The padded leg covering of claim 1, the padding further comprises a soft foam layer selected from a group consisting of polyurethane, silicone, and other soft elastic materials;

the padding further comprises a pad cover made out of a stretch fabric material, the pad cover encapsulates the padding, supports weight of the padding, and provides a uniform look to the padding; in this manner, aesthetic appearance of the padded leg covering is maintained.

3. The padded leg covering of claim 1, the leg covering is made from a non-slip grip fabric, the non-slip grip fabric is sewn into a top interior of the leg covering in an inner hem, and can cling to the user's leg via friction, this allows the user to place the leg covering at a fixed height; this enables the user with a prosthetic limb to have more security that the padded leg covering will remain in a fixed position.

4. The padded leg covering of claim 1, the leg covering is a legging in order to make the leg look appealing, the legging comprises a stretch fabric material; this provides flexibility to expand as the user sheaths their legs with the legging and contracts sufficiently on removal to be put away in an organized drawer.

5. The padded leg covering of claim 1, the leg covering is a pantyhose in order to enhance thermal insulation, the pantyhose comprises a non-detachable stretch fabric material to cover a hip region, which is affixed to the leg covering via sewing or manufactured as one piece; in this manner, the user may use the pantyhose to support sanitary products, and enhance thermal insulation of a user's natural body heat.

6. The padded leg covering of claim 1, the leg covering is further mechanically coupled to stirrups in order to increase durability while dancing, the leg covering with the stirrups comprises a non-detachable stretch fabric material that partially covers a foot region in a shape of a stirrup, which is affixed via sewing or manufactured as one piece; a stirrup-shaped partial foot covering allows the user to use the leg covering with the stirrups for ballet or dance applications which prevents heel and toe wear and tear that is common to pirouette turns.

7. The padded leg covering of claim 1, the leg covering is further mechanically coupled to straps in order to attach a garter belt, the leg covering with the straps comprises a detachable fabric strap, the detachable fabric strap should be detachably affixed to the top of the leg covering; this allows the user to attach the leg covering to the garter belt via the detachable fabric strap which holds up the leg covering and maintains the positioning of the padding for the natural and fixed appearance.

* * * * *